United States Patent [19]

Liaw

[11] Patent Number: 5,009,336

[45] Date of Patent: Apr. 23, 1991

[54] STRUCTURE OF A MULTIPURPOSE, HAND-HELD SWIVEL TYPE STATIONERY CASE

[76] Inventor: Peter Liaw, 25 Lane 60, Alley 164 Fu Lin Street, Taipei, Taiwan

[21] Appl. No.: 518,372

[22] Filed: May 3, 1990

[51] Int. Cl.[5] ..... A47F 7/00

[52] U.S. Cl. ..... 211/69.1; 211/131; 211/70; 206/214

[58] Field of Search ..... 206/44 R, 44.11, 214, 206/224, 371, 443; 211/69.1, 70, 78, 95, 131; 248/131

[56] References Cited

U.S. PATENT DOCUMENTS

| | | | |
|---|---|---|---|
| D. 160,688 | 10/1950 | Brock | 211/78 |
| 2,553,880 | 5/1951 | Stigler | 211/78 |
| 3,327,688 | 6/1967 | Smith | 206/214 |
| 3,489,289 | 1/1970 | Scott-Fenton | 211/78 |
| 3,503,523 | 3/1970 | Hamilton et al. | 211/131 |
| 3,972,419 | 8/1976 | Short | 211/78 |
| 4,305,511 | 12/1981 | Denholtz | 211/70 |
| 4,773,544 | 9/1988 | McCarthy | 206/214 |
| 4,795,710 | 1/1989 | Muszak et al. | 211/78 |

FOREIGN PATENT DOCUMENTS

| | | | |
|---|---|---|---|
| 521002 | 3/1931 | Fed. Rep. of Germany | 206/214 |

*Primary Examiner*—David T. Fidei

*Attorney, Agent, or Firm*—Lowe, Price, LeBlanc, Becker & Shur

[57] ABSTRACT

Provided is a multipurpose, hand-held swivel type stationery case, which comprises a swivel casing swiveling on a base and having a slotted, trapezoidal pen rack mounted on its top for holding a variety of writing or drawing devices, and a handle releasably fastened in the trapezoidal pen rack for the holding of the hand to lift the whole assembly. The casing has a case-like body for receiving writing materials, a plurality of hollow, unitary, obliquely conical columns on its corners for holding pens or other elongated writing materials, and a plurality of side bumpers between the columns to define therewith a plurality of receiving spaces for receiving small writing materials.

1 Claim, 3 Drawing Sheets

STRUCTURE OF A MULTIPURPOSE, HAND-HELD SWIVEL TYPE STATIONERY CASE

BACKGROUND OF THE INVENTION

The present invention is related to stationery cases for holding writing materials and more particularly to a multipurpose, hand-held swivel type stationery case for holding a variety of writing and drawing devices and writing materials.

In performing paper working, painting or drawing, a variety of devices and writing materials may be used. For easy arrangement of writing materials or some other devices, people use to put the materials or devices in a pen rack, stationery case or some other containers. However, it is not practical to use a conventional pen case for holding pens and other writing materials all together. When a variety of writing materials such as clips, pins, staples, etc., are disorderly put in a pen case, it will be very inconvenient to pick up a specific item. If to receive a specific item by a specific container, there must be prepared a variety of pen cases and containers.

It is therefore, an object of the present invention to provide a stationery case which can orderly receive a variety of writing materials. Another object of the present invention is to provide a stationery case which can be rotated for conveniently placing writing materials therein or picking up writing materials therefrom. Still another object of the present invention is to provide a stationery case which includes a releasable handle convenient for the holding of the hand.

SUMMARY OF THE INVENTION

The present invention is to provide a multipurpose, hand-held swivel type stationery case, which combines the advantages of conventional pen racks and stationery cases and is suitable for holding a variety of pens, drawing devices and writing materials. A slotted pen rack is mounted on a swivel casing which is revolvably mounted on a base and defines therein a variety of receiving chambers for holding a variety of writing materials. A handle is releasably fastened in the slotted pen rack conveniently for the holding of the hand.

BRIEF DESCRIPTION OF THE DRAWINGS

The present invention will now be described by way of example with reference to the annexed drawings, in which.

DETAILED DESCRIPTION OF THE INVENTION

Figure 1:
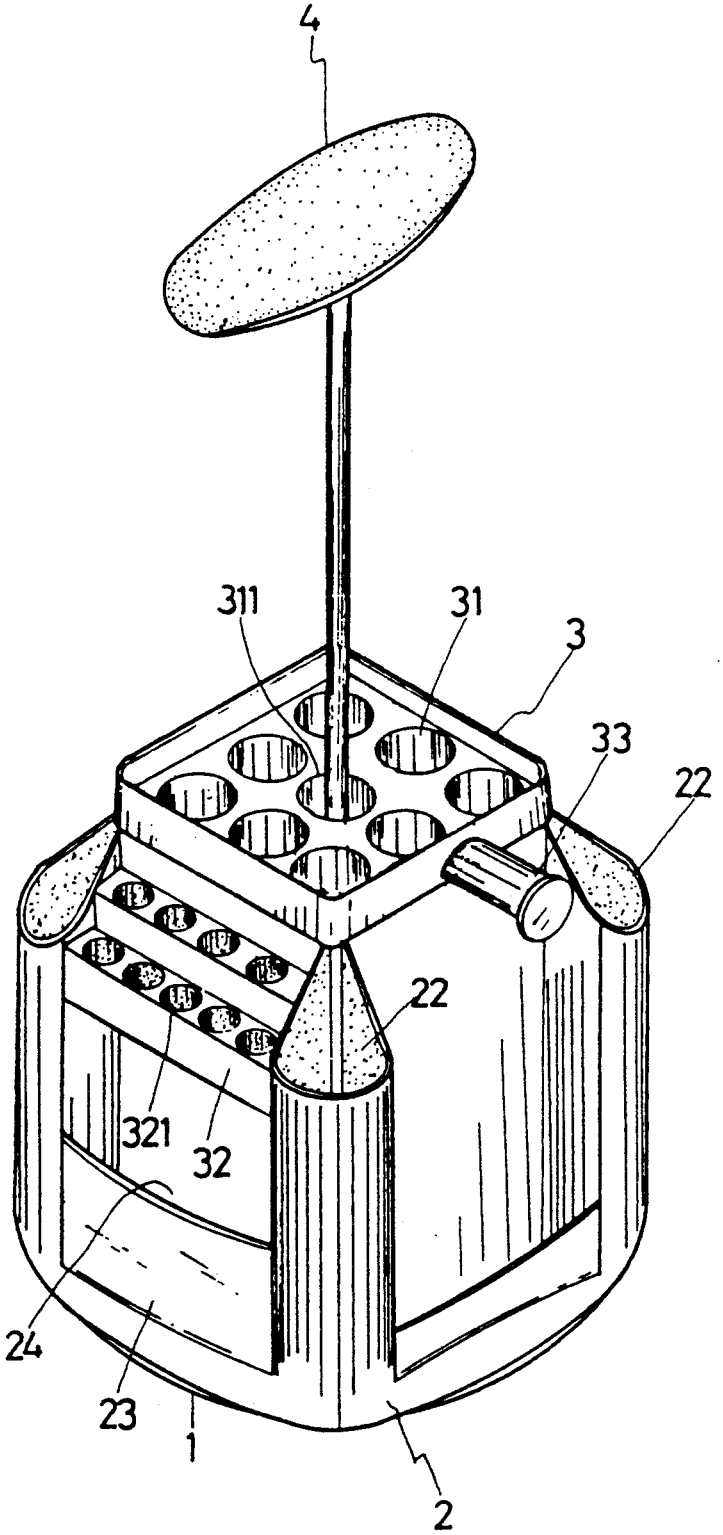
FIG. 1 is a perspective view of a stationery case embodying the present invention.
Figure 2:
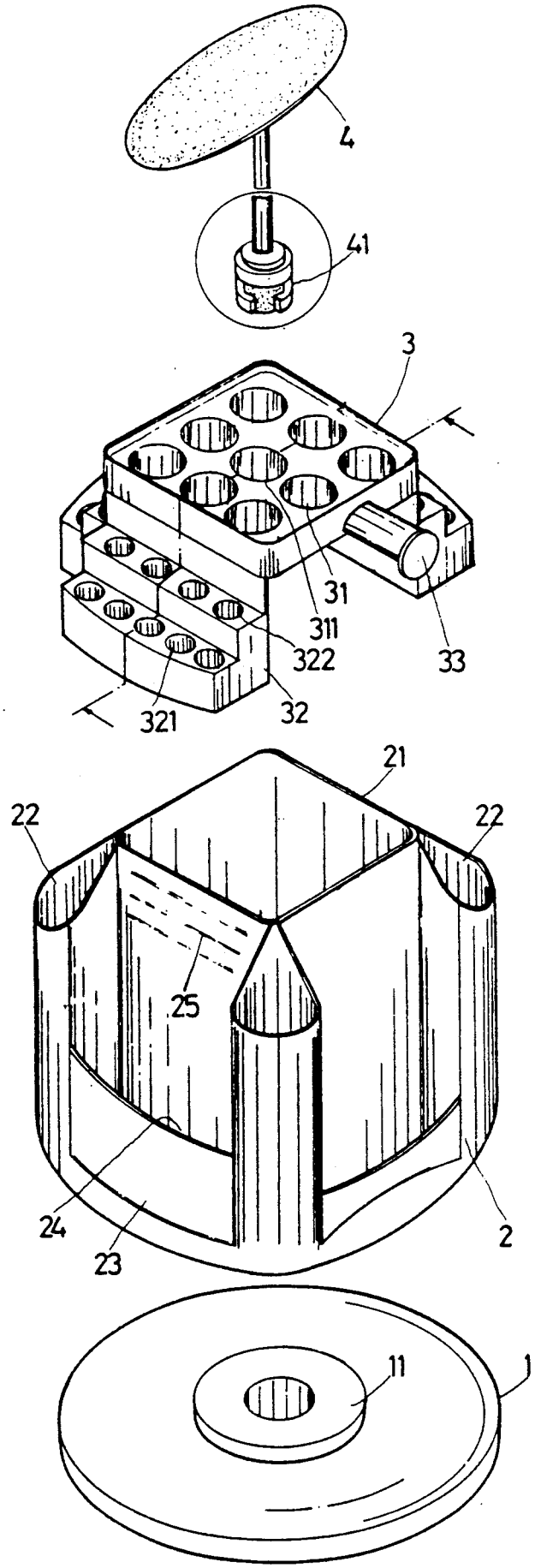
FIG. 2 is a perspective fragmentary view thereof.
Figure 3A:
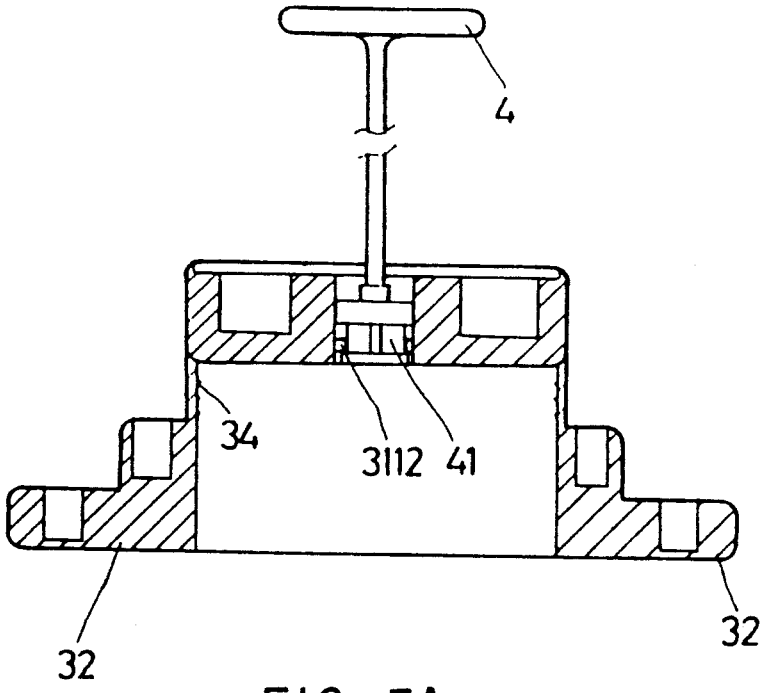
FIGS. 3A and 3B are sectional views thereof, illustrating the fastening of the handle in the slotted, trapezoidal pen rack.
Figure 3B:
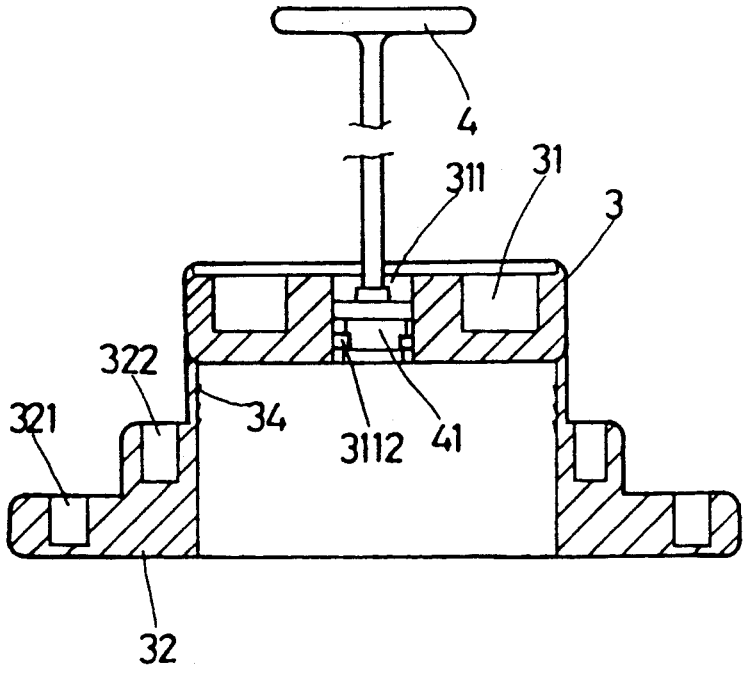

Referring to the annexed drawings in greater detail, a multipurpose, hand-held swivel type stationery case in accordance with the present invention is comprised of a base 1, a casing 2, a trapezoidal pen rack 3 and a handle 4. The base 1 can be designed either in circular or square shape having a ball bearing 11 in the center for the fastening therein of the casing 2 permitting the casing 2 to rotate thereon. The casing 2 comprises a body 21 in cubic or any preferred shape, having a plurality of hollow, unitary, obliquely conical columns 22 on the corners thereof for holding pens or other elongated writing materials. A side bumper 23 is made between each two adjacent columns 22 to respectively define with the body 21 of the casing 2 a receiving space 24 for receiving small writing materials. A plurality of transverse, elongated grooves 25 are made on the wall surface of the body 21 at suitable locations for mounting the trapezoidal pen rack 3.

The trapezoidal pen rack 3 comprises a recessed top flat board having a plurality of holes 31 thereon. Three stepped side boards 32 respectively extend downward outward from the recessed top flat board of the trapezoidal pen rack 3 at three different sides. The stepped side boards 32 have each a plurality of lines of holes 321, 322 on its steps. A suspension rod 33 extends horizontally outward from the open side of the recessed top flat board of the trapezoidal pen rack 3 for suspending hand palette. A plurality of projecting portions 34 are made on the inner surface of the vertical wall of the trapezoidal pen rack 3 at locations corresponding to the transverse, elongated grooves 25 of the casing 2. When the trapezoidal pen rack 3 is mounted on the casing 2, the projecting portions 34 are respectively fastened in the elongated grooves 25 so that the trapezoidal pen rack 3 is firmly secured to the casing 2. A plurality of projecting strips 3112 are made on the bottom end of the boring bore of the central hole 311 on the recessed top flat board of the trapezoidal pen rack 3 for releasably fastening therein of the expanded bottom end 41 of the handle 4. The expanded bottom end 41 of the handle 4 has a purality of projecting strips thereon. When the handle 4 is rotated through a certain degree of angle after it is inserted in the central hole 311, the projecting strips of the expanded bottom end 41 of the handle 4 become respectively engaged with the projecting strips 3112 of the central hole 311 of the trapezoidal pen rack 3. When the handle 4 is not in use, it can be removed from the trapezoidal pen rack 3 easily by proceeding the foregoing procedure reversely.

What is claimed is:

1. A multipurpose, hand held rotary type stationery case comprising:

a disk shaped base having a ball bearing mounted in the center of the upper surface thereof;

a casing having a depression in the bottom surface, rotatably mounted on said base with the ball bearing received in the depression, a plurality of vertically disposed upwardly opening hollow cones mutually spaced around the periphery of said casing and a plurality of pockets, one disposed between each pair of cones mounted on said casing in the lower portion thereof, and said casing defining a plurality of horizontally extending grooves between each pair of cones in the upper portion thereof;

a trapezoidal pen rack comprising a recessed top flat board having a plurality of holes therein for holding pens, and a center hold with a plurality of projection strips on the bottom internal surface of said center hold, a plurality of step sideboards extending downwardly and outwardly from said recessed top flat board at all each side except one, said stepped sideboards having a purality of holes on each step, a suspension rod extending outwardly from the open side of said recessed top flat board, and a plurality of projecting portions on the inner surface of said vertical wall of said step sideboards, each projection portion extending into a groove in said casing for mounting said rack thereon; and a handle having an expanded bottom end releasably fastened in the center hole of said rack, said expanded bottom end having a plurality of projecting strips thereon for engaging the projecting strips within said center hold.

* * * * *